US005448008A

United States Patent [19]

Okamoto et al.

[11] Patent Number: 5,448,008

[45] Date of Patent: Sep. 5, 1995

[54] MUSICAL-TONE CONTROL APPARATUS WITH MEANS FOR INPUTTING A BOWING VELOCITY SIGNAL

[75] Inventors: Tetsuo Okamoto; Eiichiro Aoki; Satoshi Usa, all of Hamamatsu, Japan

[73] Assignee: Yamaha Corporation, Japan

[21] Appl. No.: 349,380

[22] Filed: Dec. 5, 1994

Related U.S. Application Data

[63] Continuation of Ser. No. 633,093, Dec. 21, 1990, abandoned.

[30] Foreign Application Priority Data

Dec. 22, 1989 [JP] Japan ..... 1-333987
Dec. 22, 1989 [JP] Japan ..... 1-333988
Dec. 25, 1989 [JP] Japan ..... 1-336022

[51] Int. Cl.[6] ..... G10H 1/18

[52] U.S. Cl. ..... 84/658; 84/471 R; 84/483.1

[58] Field of Search ..... 84/470 R, 471 R, 483.1, 84/DIG. 7, DIG. 12, DIG. 24, 600, 644, 670, 718–721, 743–746, 615, 626, 658, 687–690

[56] References Cited

U.S. PATENT DOCUMENTS 3,376,778 4/1968 Musser ..... 84/DIG. 7
3,439,568 4/1969 Griffith ..... 84/DIG. 12
3,460,425 8/1969 Kiepe ..... 84/470 R
3,592,098 7/1971 Zadig ..... 84/483.1 X
3,626,350 12/1971 Suzuki et al. ..... 84/DIG. 7
3,754,495 8/1973 Honegger .
3,956,958 5/1976 Nash et al. ..... 84/DIG. 7
4,067,253 1/1978 Wheelwright et al. ..... 84/687
4,904,222 2/1990 Gastgeb et al. ..... 84/DIG. 24
4,909,117 3/1990 Reiling et al. ..... 84/DIG. 12
4,958,551 9/1990 Lui ..... 84/DIG. 12
4,980,519 12/1990 Mathews ..... 84/744 X
5,081,896 1/1992 Hiyoshi et al. ..... 84/600

FOREIGN PATENT DOCUMENTS 2733825 2/1979 Germany .
48-42963 12/1973 Japan .
63-40199 2/1988 Japan .

OTHER PUBLICATIONS

The Board of Trustees of the Leland Stanford Univ.; Digital Signal Processingusing Waveguide Networks; Apr. 29, 1987; European Patent Application #87303803.8.

*Primary Examiner*—Stanley J. Witkowski
*Attorney, Agent, or Firm*—Graham & James

[57] ABSTRACT

In order to simulate sounds of an acoustic musical instrument such as a bowed stringed instrument, an electronic musical instrument employs a musical tone control apparatus which at least contains an operating device and a detecting circuit. Herein, when operating the operating device which can be operated in a two-dimensional area, the detecting circuit detects operation information corresponding to an operating position or an operating displacement of the operating device. Then, velocity information is generated based on the operation information. Thereafter, a musical tone is generated in response to a musical characteristic corresponding to the velocity information under a condition where the operating device is now operating. Preferably, the operating device is configured by a digitizer on which surface an electronic pen is moved two-dimensionally by the performer. Thus, it is possible to impart the varied performance expression to the musical tone to be generated.

18 Claims, 17 Drawing Sheets

(CONFIGURATION OF ELECTRONIC MUSICAL INSTRUMENT)

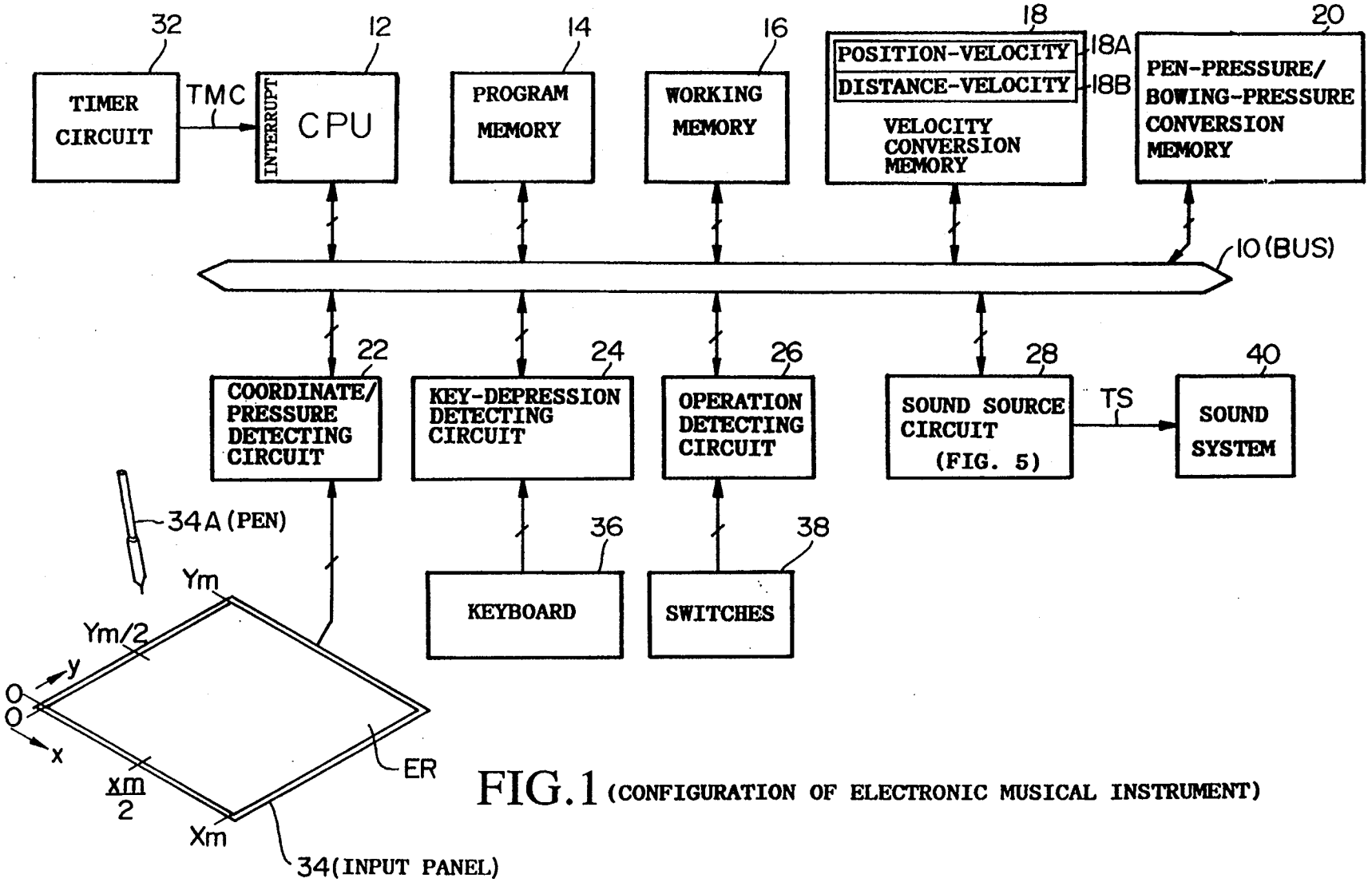
FIG. 1 (CONFIGURATION OF ELECTRONIC MUSICAL INSTRUMENT)

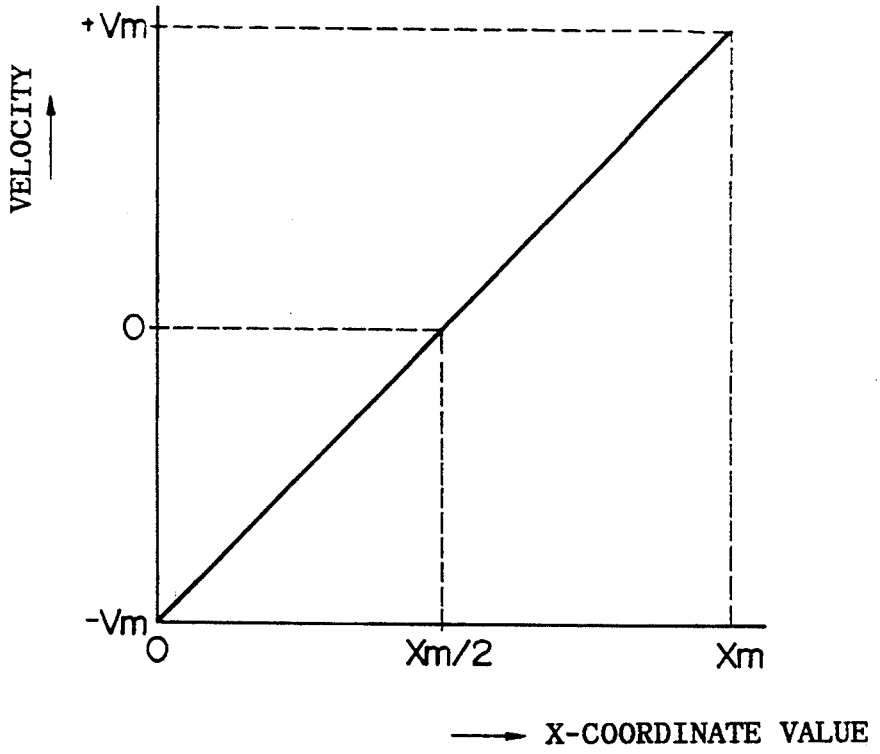
FIG.2 (CONVERSION CHARACTERISTIC OF MEMORY 18A)
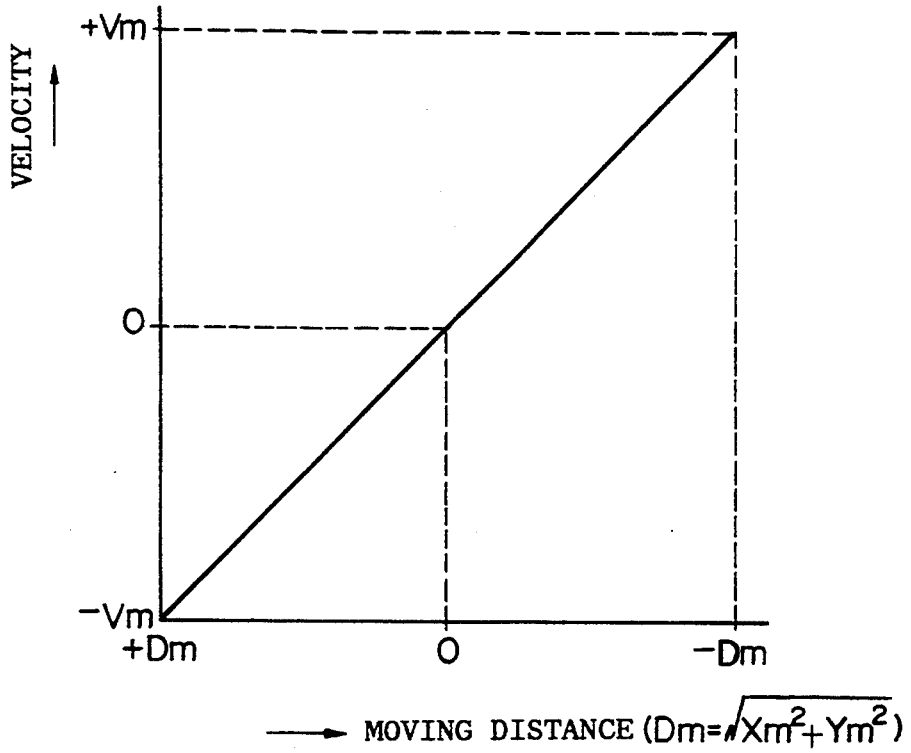
FIG.3 (CONVERSION CHARACTERISTIC OF MEMORY 18B)

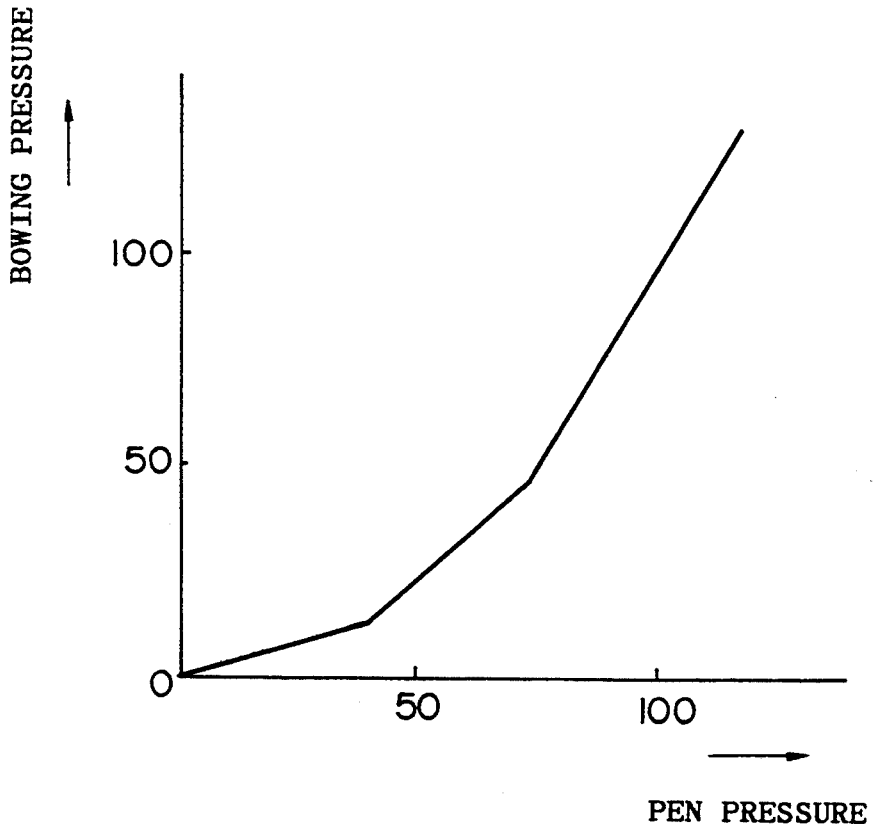
FIG.4 (CONVERSION CHARACTERISTIC OF MEMORY 20)

(CONFIGURATION OF SOUND SOURCE CIRCUIT 28)

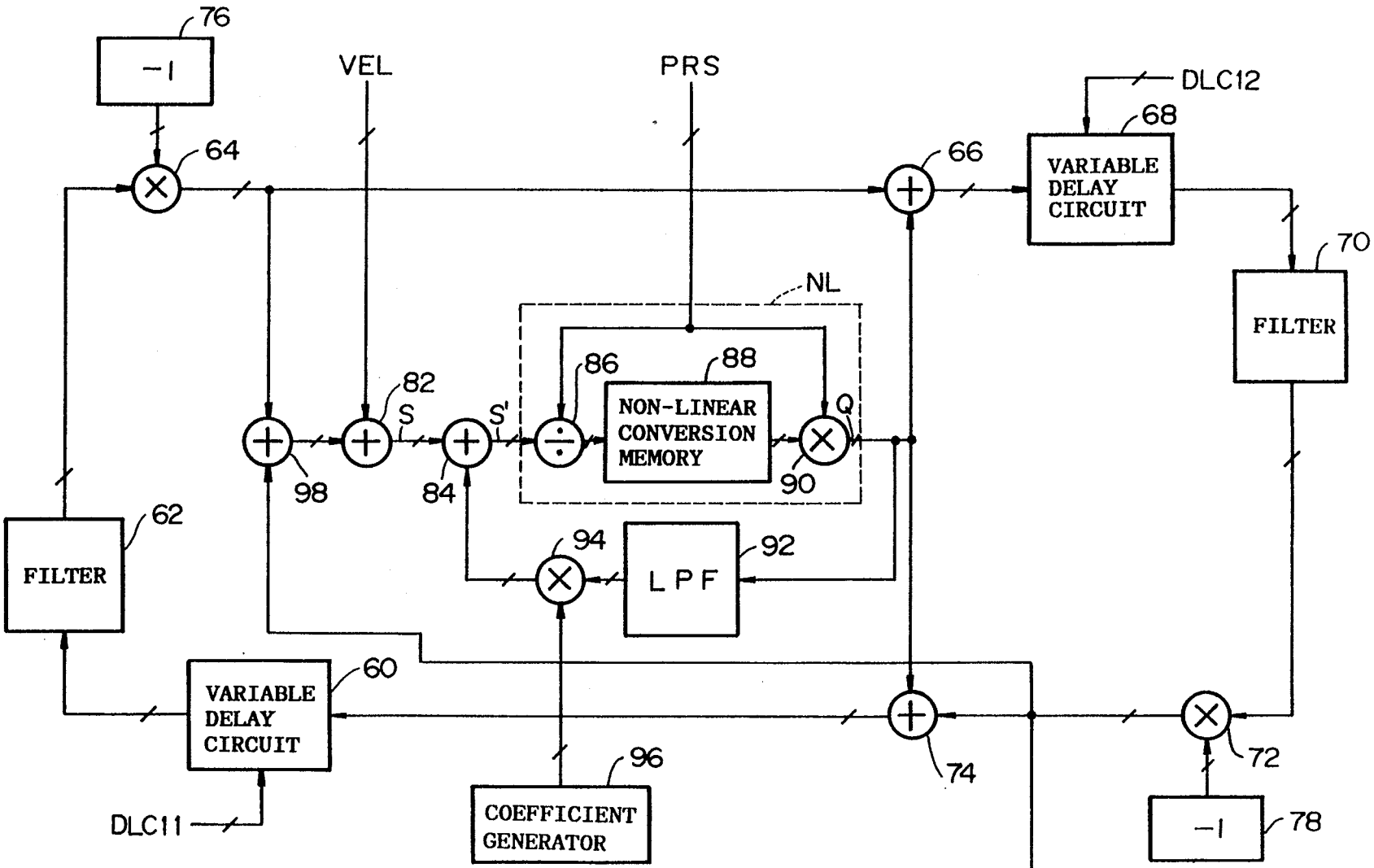
FIG. 6 (CONFIGURATION OF SOUND SOURCE TG1)

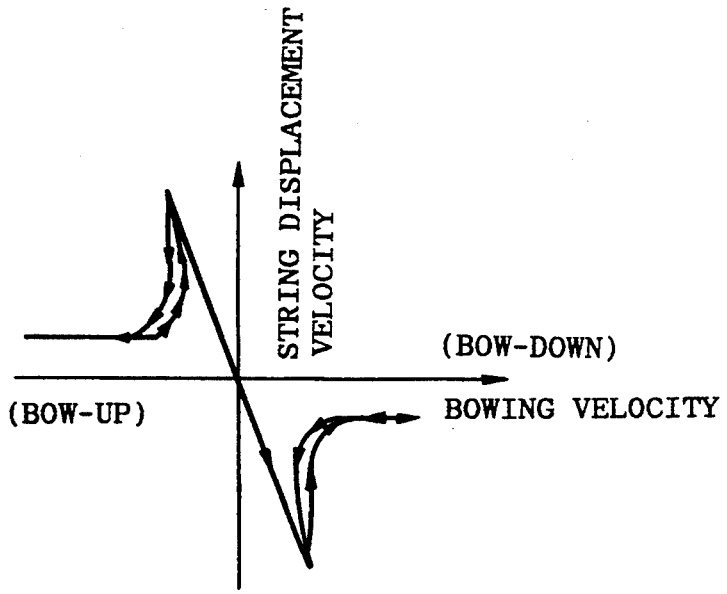
FIG.7 (NON-LINEAR VARIATION OF BOWED STRING)
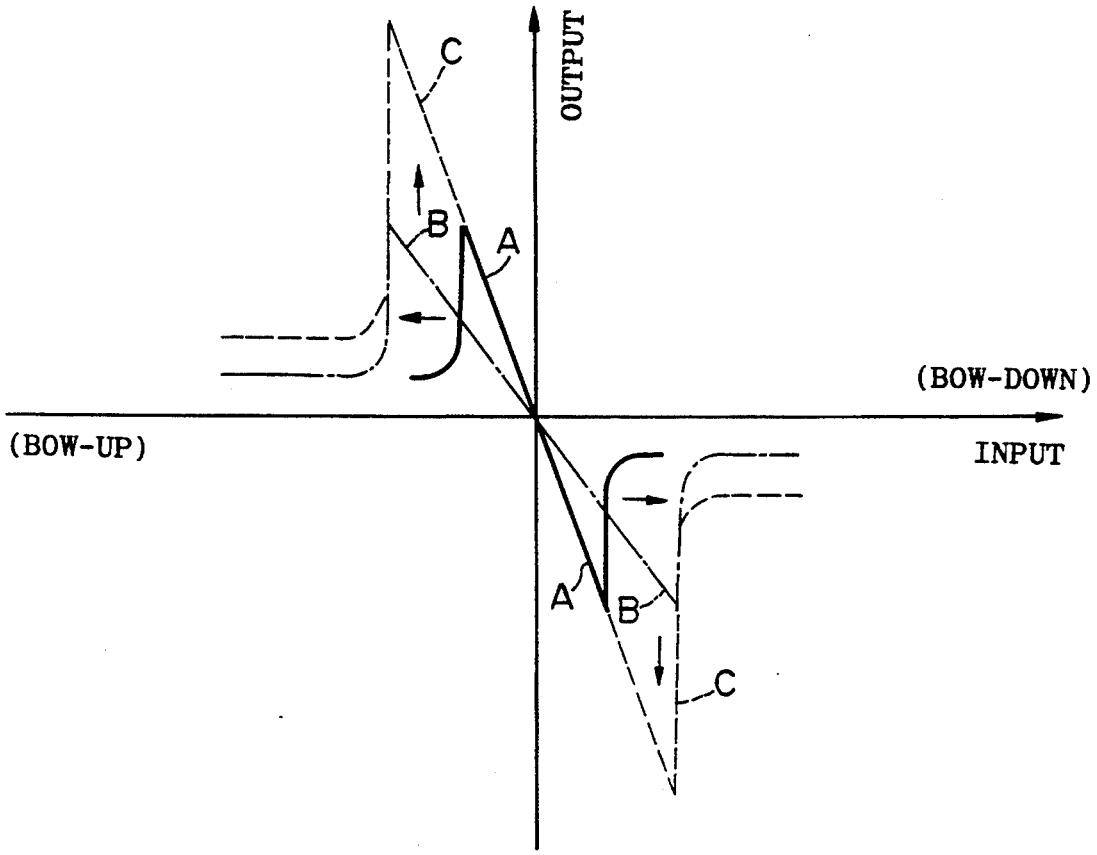
FIG.8 (NON-LINEAR CONVERSION CHARACTERISTIC)

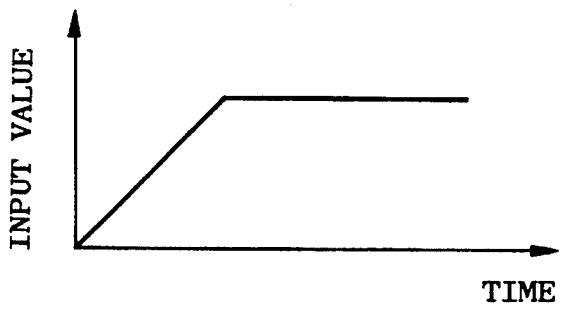
FIG.9 (INPUT FOR CONVERSION)
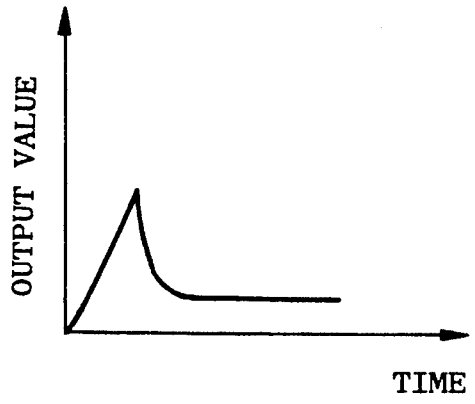
FIG.10 (OUTPUT FOR CONVERSION)

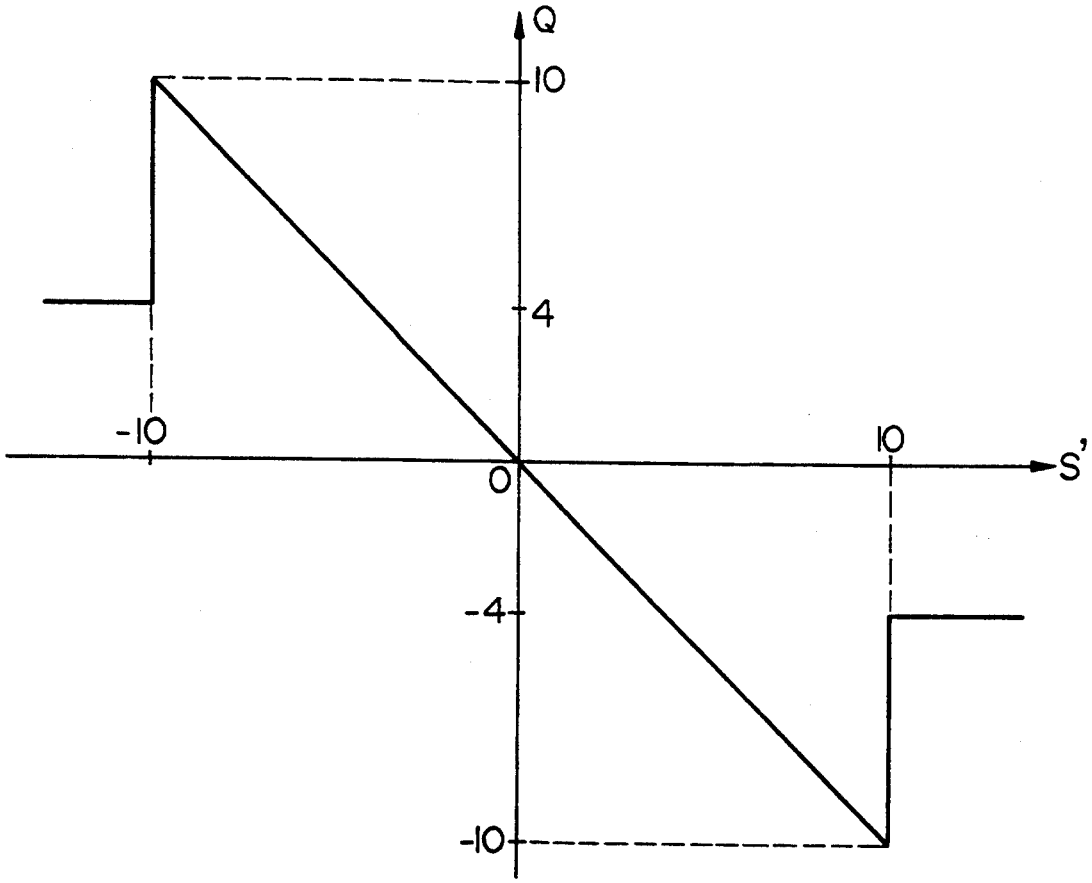
FIG.11 (NON-LINEAR CONVERSION CHARACTERISTIC)

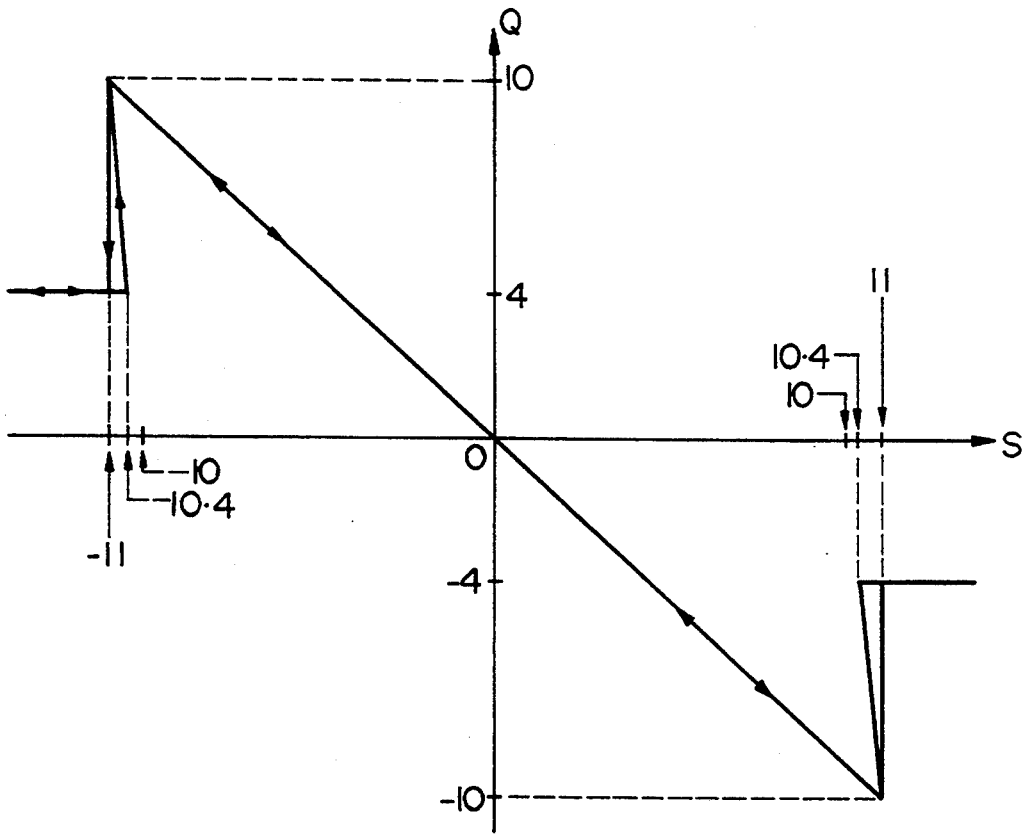
FIG. 12 (HYSTERESIS CHARACTERISTIC DUE TO FEEDBACK LOOP)

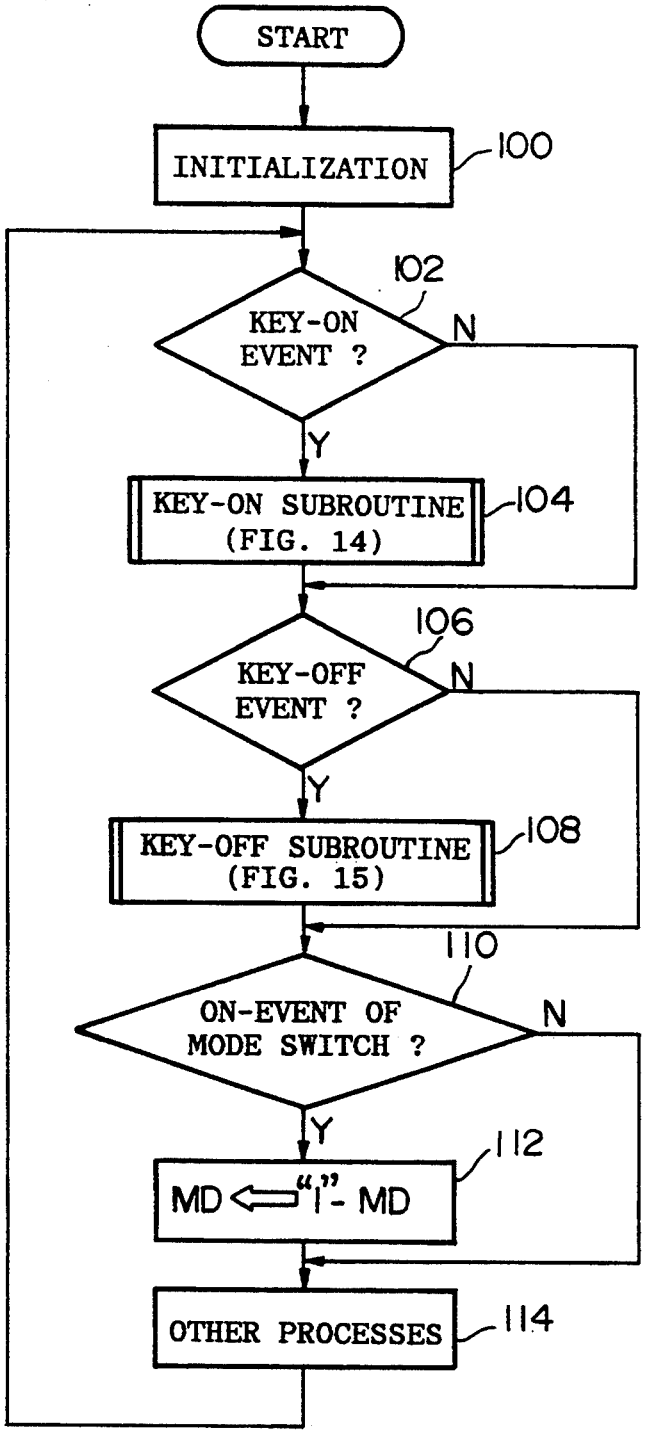
FIG.13 (MAIN ROUTINE)

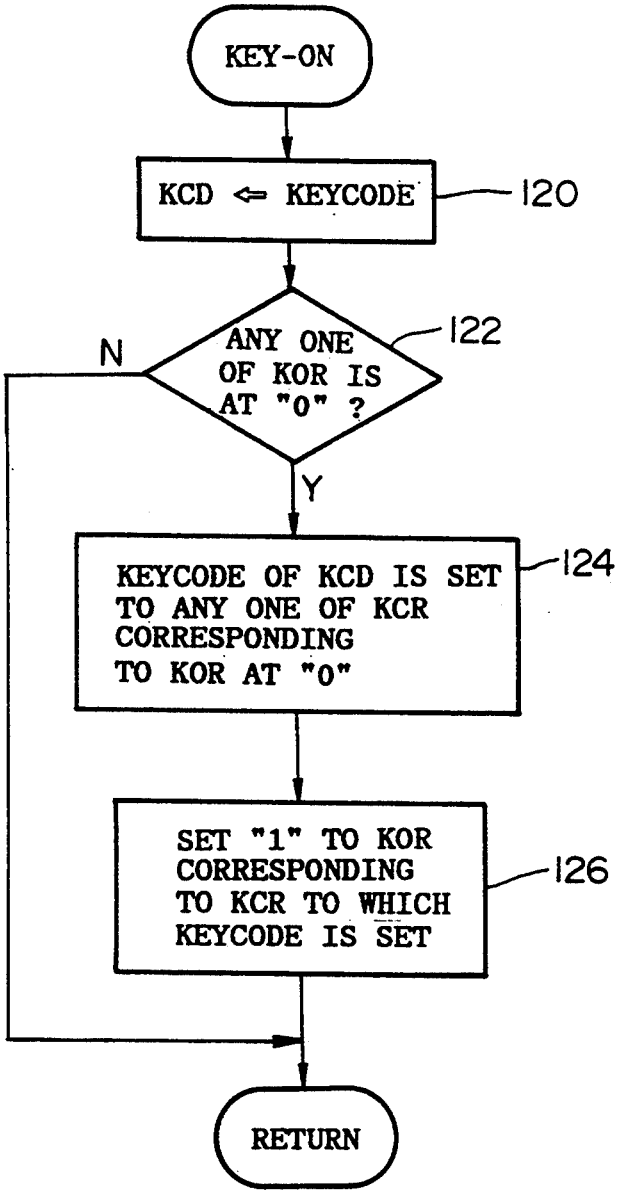
FIG.14 (KEY-ON SUBROUTINE)

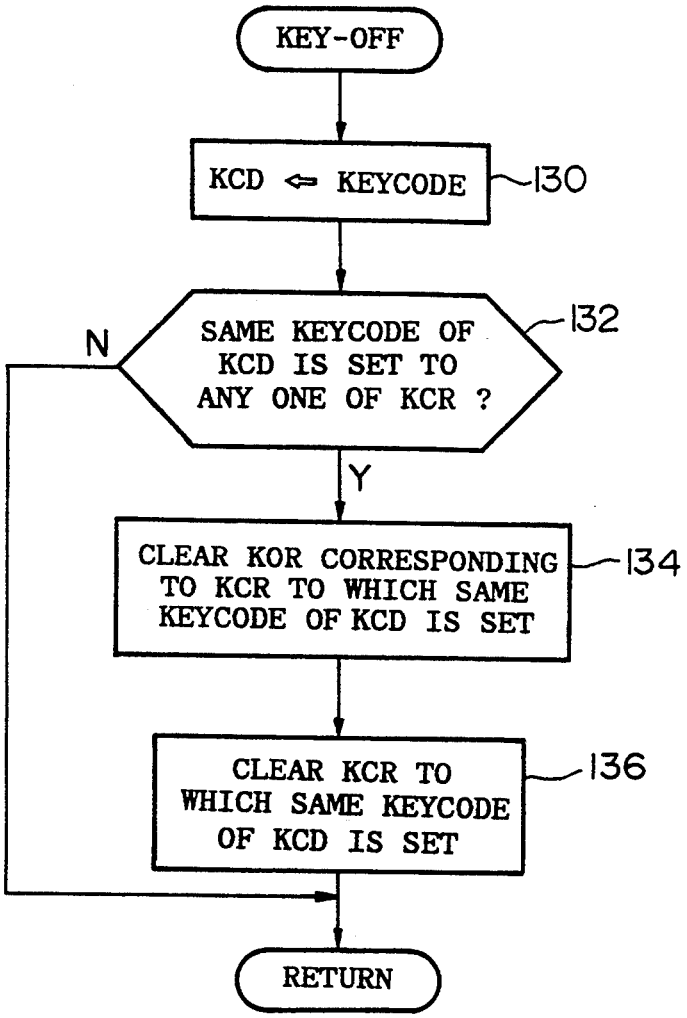
FIG. 15 (KEY-OFF SUBROUTINE)

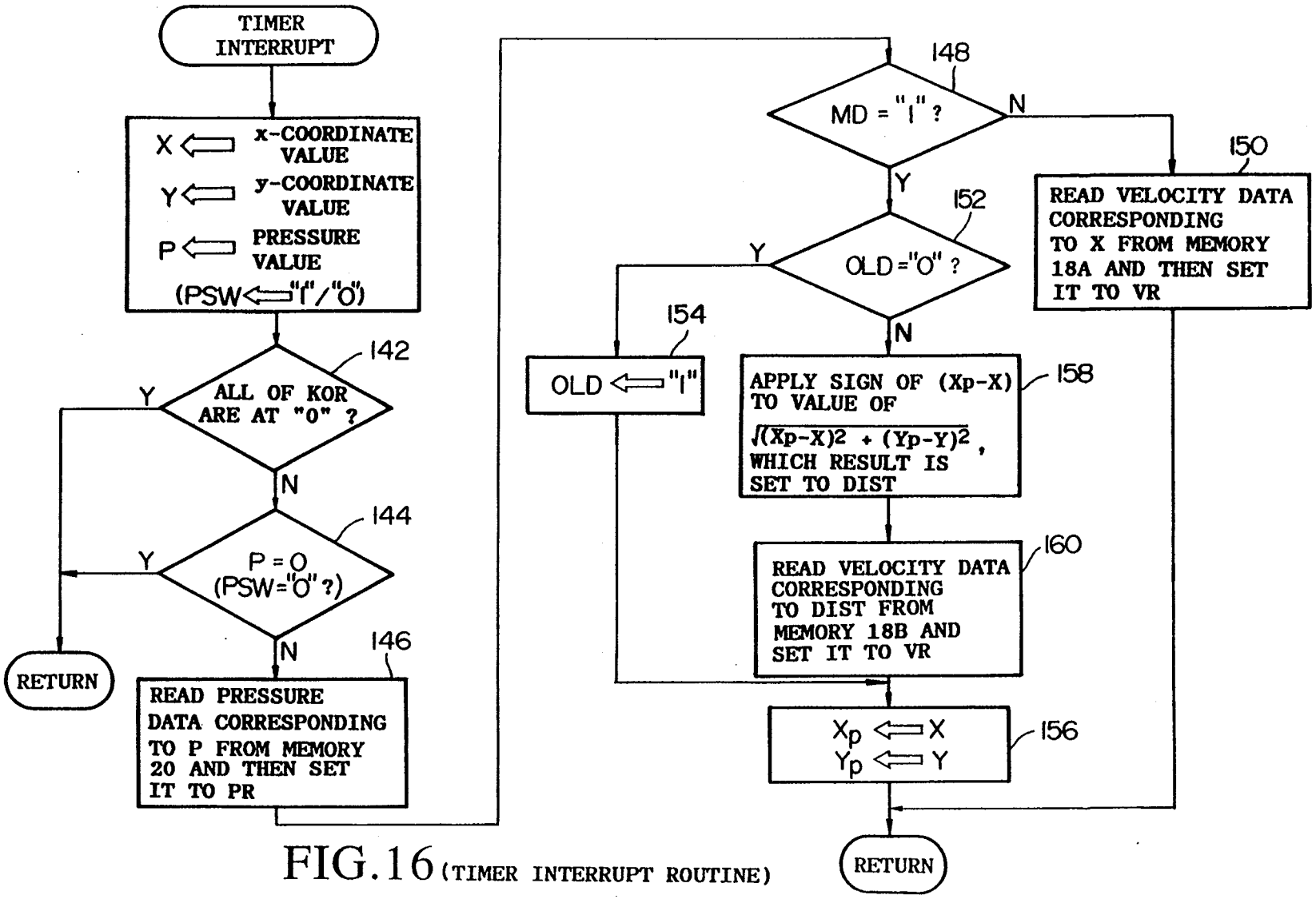
FIG. 16 (TIMER INTERRUPT ROUTINE)

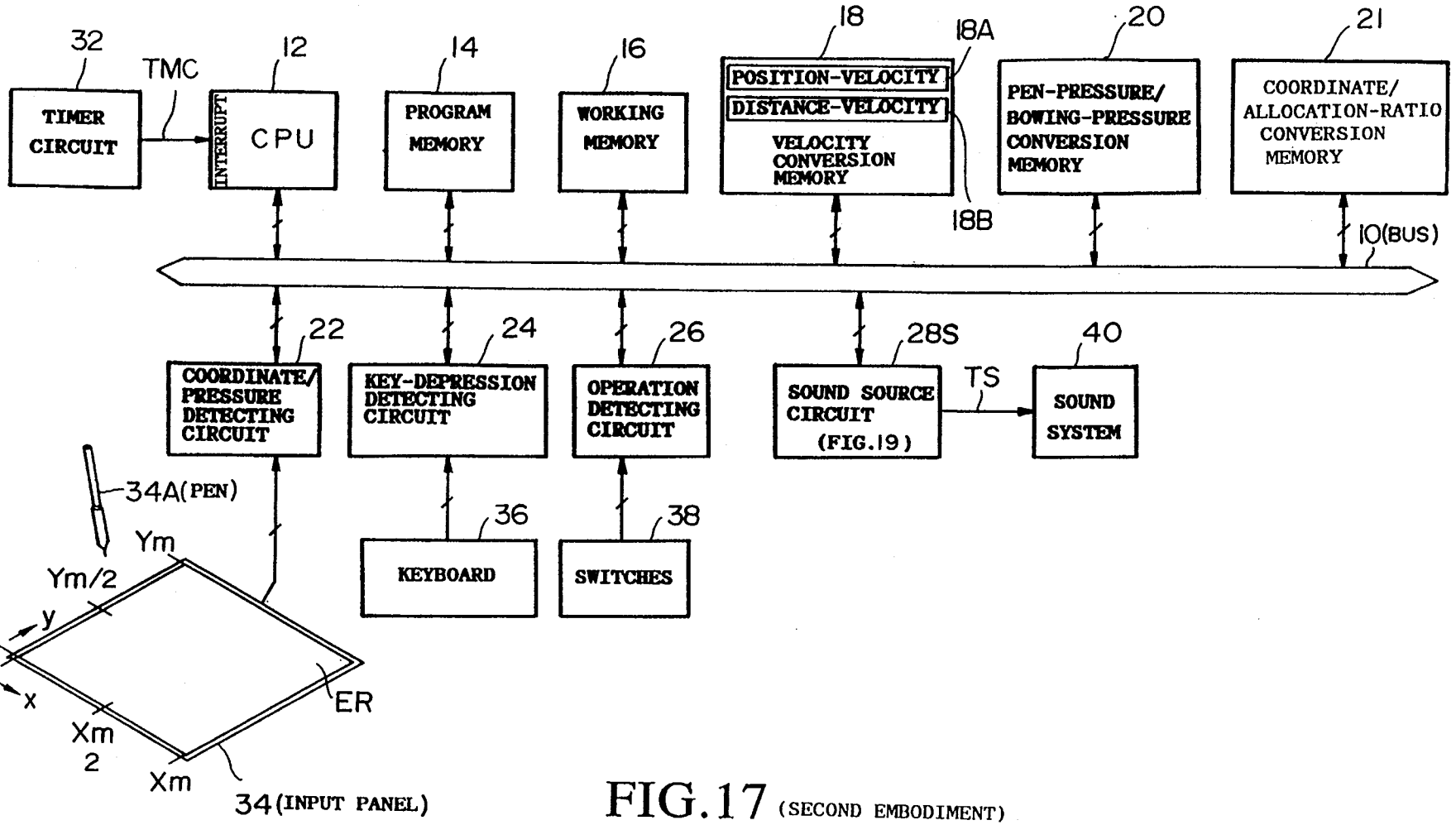
FIG. 17 (SECOND EMBODIMENT)

(CONVERSION CHARACTERISTIC OF MEMORY 21 OF FIG. 17)

(CONFIGURATION OF SOUND SOURCE CIRCUIT 28S OF FIG. 17)

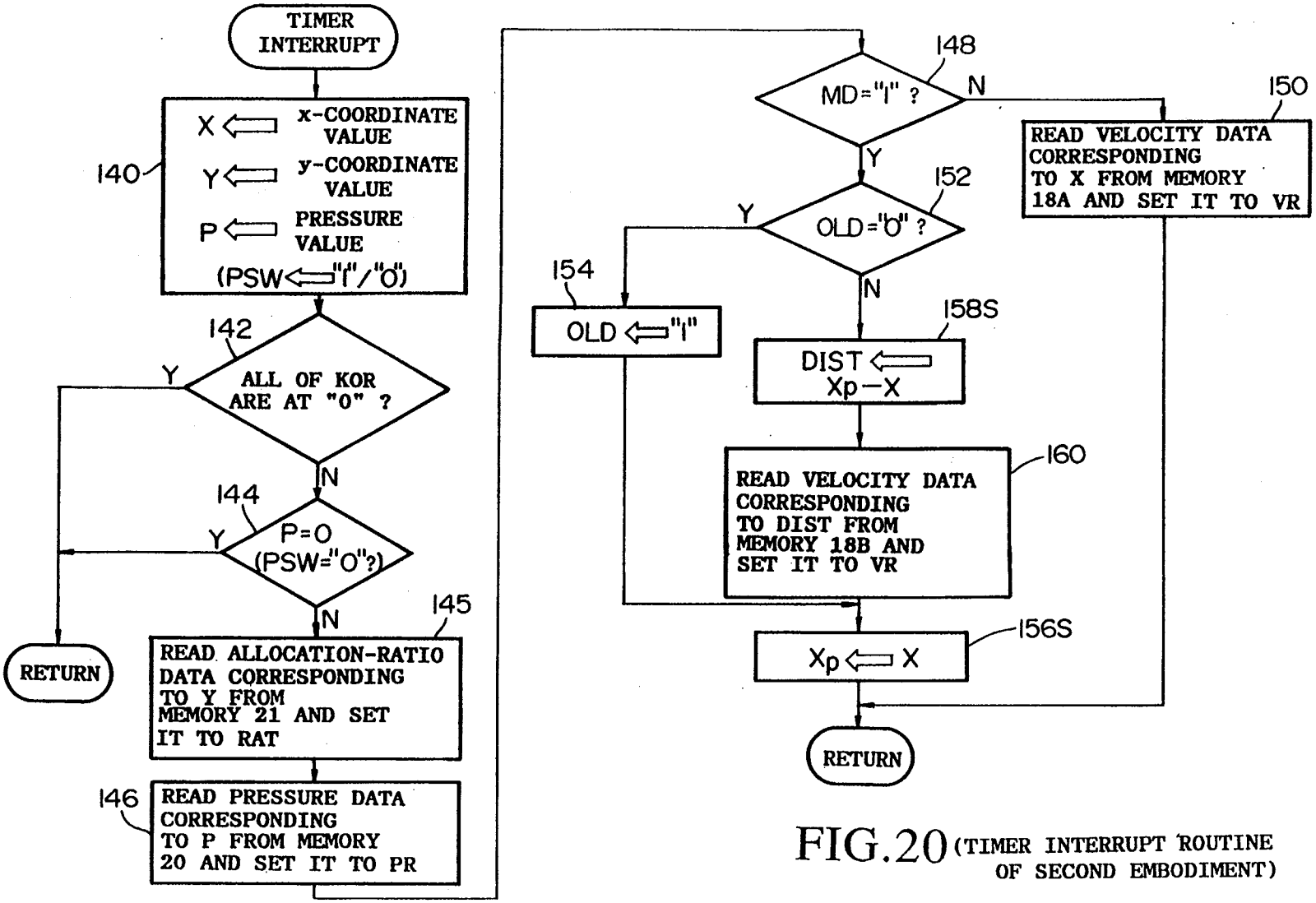
FIG. 20 (TIMER INTERRUPT ROUTINE OF SECOND EMBODIMENT)

MUSICAL-TONE CONTROL APPARATUS WITH MEANS FOR INPUTTING A BOWING VELOCITY SIGNAL

This is a continuation of application Ser. No. 07/633,093, filed on Dec. 21, 1990, and now abandoned.

BACKGROUND OF THE INVENTION

1. Field of the Invention

The present invention relates to a musical tone control apparatus which is suitable for simulating a tone-generation mechanism of an non-electronic musical instrument such as the bowed stringed instrument and wind instrument.

2. Prior Art

Some of the conventionally known electronic musical instruments providing the musical tone control apparatus can control musical characteristics such as the tone color and tone volume in response to the operating speed, operating pressure and the like thereof. Some of them can also detect the key depressing velocity of the key in the keyboard to thereby control the musical tone waveform at its attack portion, while the other can detect the key depressing pressure during the key depressing period to thereby control the musical tone waveform at its sustained portion.

In general, the bowed stringed instrument such as the violin, cello and viola can designate the rise time and fall time of the musical tone by the bowing operation, independent of the pitch designating operation by the fingers of the performer. In addition, by use of the bowing velocity and bowing pressure, it is possible to impart the varied characteristics to the musical tone such that the attack portion, sustained portion and decay portion will be formed in the musical tone waveform.

In contrast, in the aforementioned conventional electronic musical instrument, the pitch, rise time, fall time of the musical tone must be determined by the key operation, so that unlike the bowed stringed instrument, it is not possible to determine the rise time and fall time of the musical tone by the bowing operation independent of the pitch designating operation. In addition, when controlling the rising waveform in response to the key depressing velocity or when controlling the sustaining waveform in response to the key depressing pressure, it is not possible to arbitrarily designate the key depressing velocity or key depressing pressure independent of the key depressing operation, which limits the waveform range to be controlled. Thus, unlike the bowed stringed instrument, the conventional electronic musical instrument cannot impart the varied characteristics to the musical tone.

Meanwhile, in the bowed stringed instrument, when applying the external force of the bow to the string at the position which is relatively close to the fixed terminal, the sound becomes relatively hard, indicating that the sound contains a plenty of higher-harmonic overtones. In contrast, when applying the external force to the string at the position which is relatively close to the middle point of the string, the sound becomes relatively soft. For example, there are provided two performance methods of the violin wherein the string-bowing point is changed, i.e., "slur ponticello" in which the bowing operation is carried out at the string position close to the bridge and "slur tasto" in which the bowing operation is carried out on the fingering board. In short, the violin positively uses the variation of tone color due to the change of the string-bowing point.

In contrast, the conventional electronic musical instrument detects the key-depressing velocity by measuring the time required to change the contact position of the switch interlocked with the key. Therefore, only one velocity information can be obtained by every key-depression. In other words, it is not possible to perform the musical tone control in response to the change of the operating velocity of the bow. Further, the movable range of the key is relatively small, which narrows the velocity range which can be designated in response to the key-depression. Therefore, it is not possible to arbitrarily designate the operating velocity of the bow within the relatively broad range.

Moreover, even if the sustained waveform is controlled in response to the key-depressing pressure, the key-depressing velocity is not reflected in the musical tone in the conventional electronic musical instrument. Therefore, it is not possible to obtain the varied performance expression corresponding to the combination of the bowing velocity, bowing pressure and string-bowing point. In other words, unlike the bowed stringed instrument, it is not possible to apply the varied expression to the musical tone.

In short, the conventional electronic musical instrument is insufficient to simulate the tone-generation mechanism of the bowed stringed instrument.

SUMMARY OF THE INVENTION

It is accordingly a primary object of the present invention to provide a musical tone control apparatus which can well-simulate sounds of the acoustic musical instrument such as the bowed stringed instrument and wind instrument.

It is another object of the present invention to provide a musical tone control apparatus by which the musical tone can be controlled by the brand-new performance method.

In a first aspect of the present invention, there is provided a musical tone control apparatus comprising:

(a) operating means which can be operated in a two-dimensional area;

(b) detecting means for detecting operation information corresponding to an operating position or an operating displacement of the operating means;

(c) velocity information generating means for generating velocity information based on the operation information; and (d) musical tone generating means for generating a musical tone having a musical characteristic corresponding to the velocity information under a condition where the operating means is now operating.

In a second aspect of the present invention, there is provided a musical tone control apparatus comprising:

(a) operating means which can be operated in a two-dimensional area;

(b) detecting means for detecting operation information corresponding to an operating position or an operating displacement of the operating means to be moved in a first direction, the detecting means also detecting position information corresponding to an operating position of the operating means to be moved in a second direction crossing the first direction;

(c) velocity information generating means for generating velocity information based on the operation information;

(d) musical tone signal generating means for generating a musical tone signal having a musical characteristic corresponding to the velocity information; and (e) control means for controlling the musical characteristic of the musical tone signal based on the position information.

In a third aspect of the present invention, there is provided a musical tone control apparatus comprising:

(a) data circulating path which is configured by connecting first and second variable delay elements, first and second phase inverters together into a closed-loop;

(b) designating means for designating total delay quantity of the first and second variable delay elements in response to a pitch of a musical tone to be generated;

(c) operating means which can be operated in a two-dimensional area;

(d) detecting means responsive to an operation of the operating means for detecting operation information corresponding to an operating position or an operating displacement of the operating means to be moved in a first direction, the detecting means also detecting position information corresponding to an operating position of the operating means to be moved in a second direction crossing the first direction;

(e) velocity information generating means for generating velocity information based on the operation information;

(f) converting means for converting the position information into allocation-ratio information representative of an allocation rate by which the total delay quantity is allocated to the first and second variable delay elements respectively;

(g) control means for controlling respective delay quantities of the first and second variable delay elements so as to allocate the total delay quantity to the first and second variable delay elements respectively in accordance with the allocation-ratio information;

(h) input means for converting the velocity information into excitation waveform information which is inputted into and then circulating through the data circulating path; and (i) pick-up means for picking up circulating waveform information having the pitch as musical tone waveform information at a predetermined position within the data circulating path.

In a fourth aspect of the present invention, there is provided a musical tone control method comprising steps of:

detecting a movement of an operating device to be operated two-dimensionally by a performer;

converting a detected movement of the operating device into operation information;

generating velocity information based on the operation information; and generating a musical tone having a musical characteristic corresponding to the velocity information.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings:

FIG. 1 is a block diagram showing the whole configuration of an electronic musical instrument employing a musical tone control apparatus according to a first embodiment of the present invention;

FIGS. 2, 3, 4 are graphs showing conversion characteristics of conversion memories shown in FIG. 1;

FIG. 6 is a block diagram showing configuration of a sound source shown in FIG. 5;

FIG. 7 is a graph showing an example of the non-linear variation of the bowed string;

FIG. 8 is a graph showing an example of an input/output characteristic of a non-linear conversion portion shown in FIG. 6;

FIGS. 9, 10 are graphs respectively showing input and output waveforms of the non-linear conversion portion;

FIG. 11 is a graph showing an example of the non-linear conversion characteristic;

FIG. 12 is a graph showing an example of the hysteresis characteristic which can be obtained by connecting the feedback loop to the non-linear conversion portion;

FIGS. 13 to 16 are flowcharts showing operations of the first embodiment;

FIG. 17 is a block diagram showing the whole configuration of an electronic musical instrument employing a musical tone control apparatus according to a second embodiment of the present invention;

FIG. 20 is a flowchart showing a timer interrupt routine according to the second embodiment.

DESCRIPTION OF THE PREFERRED EMBODIMENTS

Figure 5:
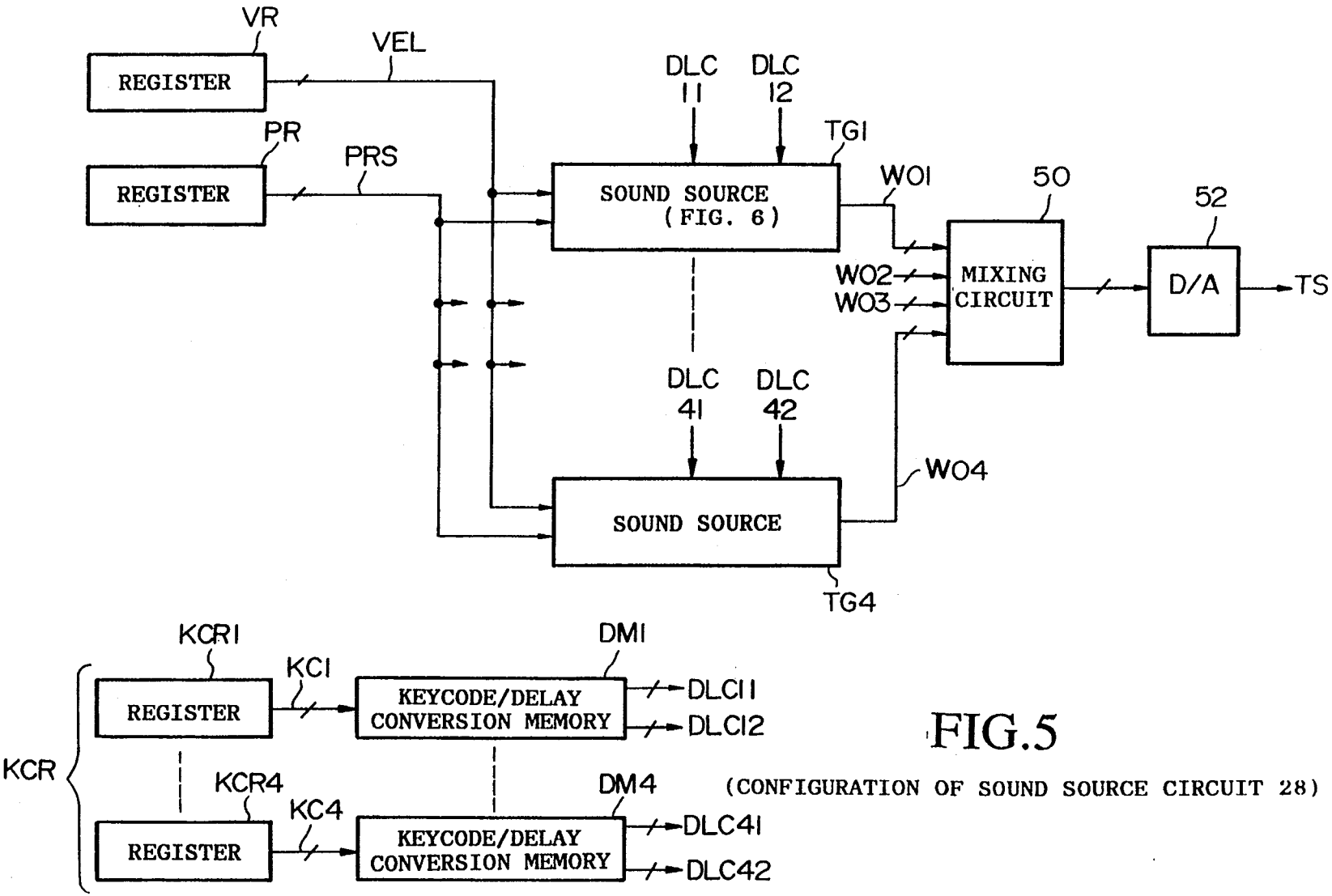
FIG. 5 is a block diagram showing configuration of a sound source circuit shown in FIG. 1.

Next, description will be given with respect to the preferred embodiments of the present invention by referring to the drawings, wherein like reference characters designate like or corresponding parts throughout the several views.

I. FIRST EMBODIMENT

FIG. 1 is a block diagram showing the whole electric configuration of an electronic musical instrument employing a musical tone control apparatus according to the first embodiment of the present invention. This electronic musical instrument is designed such that the tone generation thereof is controlled by the micro computer. In some drawings, e.g., FIGS. 1, 5, 6, a signal line accompanied with slash mark "/" indicates plural signal lines or a signal line through which data of plural bits is to be transmitted.

[A] Configuration (1) Whole Configuration (FIG. 1)

In FIG. 1, 10 designates a bus which is connected with a central processing unit (CPU) 12, a program memory 14, a working memory 16, a velocity conversion memory 18, a pen-pressure/bowing-pressure conversion memory 20, a coordinate/pressure detecting circuit 22, a key-depression detecting circuit 24, an operation detecting circuit 26 and a sound source circuit 28.

The CPU 12 is designed to carry out several kinds of processes for the tone generation in accordance with programs stored in the program memory 14. Such processes will be described later in conjunction with FIGS. 13 to 16. Herein, a timer circuit 32 is provided for the CPU 12. This timer circuit 32 generates a timer clock signal TMC having a clock period of 1 to 10 ms, preferably 3 ms, which is supplied to the CPU 12 as an interrupt command signal.

The working memory 16 contains a plurality of registers which are used when the CPU 12 carries out the processes thereof. Herein, some of these registers which relate to the present embodiment will be described later in detail.

The coordinate/pressure detecting circuit 22 provided with a two-dimensional input panel 34, which is known as the digitizer. As the digitizer, the conventional technique provides several kinds of devices which are designed according to the switch array method, fall-of-potential method, encoder method, magnetic-phase method, electrostatic coupling method, ultrasonic method, magnetic-distortion method, electromagnetic induction method, electromagnetic supply method and the like. Therefore, it is possible to use arbitrary one of them.

As the input panel 34, the present embodiment uses the device assembled by a liquid crystal display panel and a digitizer which employs the electromagnetic supply method and can detect the pressure applied thereto. In addition, an electronic pen 34A is used as the coordinate designator. As the electronic pen 34A, it is possible to use the pen providing with a pen-point switch. However, the touch detection can be achieved by the pressure detection carried out by the input panel. Thus, it is possible to use the electronic pen which is not provided with the pen-point switch. By use of the input panel 34 having the display ability, it is possible to perform the input operation with checking the displayed coordinate designated by the electronic pen 34A, which is advantageous for the performer.

The coordinate/pressure detecting circuit 22 is designed to detect the pen-pressure applied by the performer who operates the electronic pen 34 and also detect x-y coordinates which are designated by the electronic pen 34A within an effective read area ER of the input panel 34.

The velocity conversion memory 18 contains a position-velocity conversion memory 18A and a distance-velocity conversion memory 18B. Herein, the position-velocity conversion memory 18A converts x-coordinate value (indicating the operating position of the electronic pen 34A) detected by the coordinate/pressure detecting circuit 22 into velocity data in accordance with the conversion characteristic as shown in FIG. 2. On the other hand, unit-time moving distance (indicating the operating velocity of the electronic pen 34A) is computed on the basis of the x-y coordinate values detected by the coordinate/pressure detecting circuit 22, and the distance-velocity conversion memory 18B converts this unit-time moving distance into velocity data in accordance with the conversion characteristic as shown in FIG. 3. Incidentally, the first embodiment provides a mode switch (not shown) by which one of the position mode and velocity mode can be arbitrarily selected, wherein the position mode uses the velocity data corresponding to the foregoing operating position, while the velocity mode uses another velocity data corresponding to the foregoing operating velocity.

The pen-pressure/bowing-pressure conversion memory 20 is provided to obtain the pressure data matching with the pressure sensitivity of the performer. This memory 20 converts the pressure (i.e., pen pressure) detected by the coordinate/pressure detecting circuit 22 into the pressure data (i.e., bowing pressure data) in accordance with the conversion characteristic as shown in FIG. 4. Incidentally, it is possible to directly use the pressure data outputted from the coordinate/pressure detecting circuit 22 as it is without carrying out the above-mentioned conversion by the memory 20.

The key-depression detecting circuit 24 detects key-depression information (containing key-on/off information and keycode information) with respect to each key of the keyboard 36.

The operation detecting circuit 26 detects operation information with respect to each of the switches including the aforementioned mode switch provided in the switches 38.

The sound source circuit 28 forms a musical tone signal TS based on the aforementioned velocity data, pressure data, key-depression information and the like. The details will be described later in conjunction with FIG. 5.

The musical tone signal TS outputted from the sound source circuit 28 is supplied to a sound system 40 containing the output amplifier, speakers etc. (not shown), from which the corresponding musical tone will be sounded.

(2) Sound Source Circuit 28 (FIG. 5)

FIG. 5 shows an example of the sound source circuit 28, which contains four sound sources (or tone generators) TG1 to TG4 corresponding to four strings of the violin respectively. Therefore, the present embodiment can simultaneously generate maximum four sounds. Each of four sound sources TG1 to TG4 has the same configuration, therefore, detailed description will be given later with respect to TG1 only.

In FIG. 5, the velocity data read from the velocity conversion memory 18 is stored in a register VR, from which velocity data VEL is supplied to each of the sound sources TG1 to TG4. In addition, the pressure data read from the pen-pressure/bowing-pressure conversion memory 20 is stored in another register PR, from which pressure data PRS is supplied to each of the sound sources TG1 to TG4.

Meanwhile, registers KCR1 to KCR4 are provided corresponding to the sound sources TG1 to TG4 respectively, wherein they will store the keycode data (i.e., pitch data) corresponding to the depressed key in the keyboard 36. The registers KCR1 to KCR4 output keycode data KC1 to KC4, which are respectively supplied to keycode/delay conversion memories DM1 to DM4.

Each of the keycode/delay conversion memories DM1 to DM4 stores first and second delay data with respect to each key of the keyboard 86. The first and second delay data corresponding to each key are used to allocate the total delay quantity (corresponding to the pitch of each key) to first and second delay elements (e.g., delay circuits 60, 68 shown in FIG. 6) by the predetermined allocation ratio. When "D" is given as the total delay quantity (e.g., number of delay stages) and "K" is given as the allocation ratio (where K is set within the range of $0<K<1$; e.g., $K=0.5$), the first delay data is represented by "D*K" and second delay data is represented by "D*(1−K)."

For example, the keycode/delay conversion memory DM1 converts input keycode data KC1 into first and second delay data DCL11, DCL12 corresponding to its pitch, and then these delay data are supplied to the sound source TG1. Incidentally, when the value of register KCR1 is at "0" (i.e., when no keycode data is inputted), the sound source TG1 receives the delay data DLC11, DLC12 by which first and second delay elements contained in the sound source TG1 are set in the off-state.

As similar to the above-mentioned sound source TG1, other sound sources TG2 to TG4 are supplied with other delay data DLC21, DLC22 to DLC41, DLC42 respectively.

The sound sources TG1 to TG4 generate the digitized musical tone waveform data based on sound source control information such as the aforementioned data VEL, PRS, DLC11, DLC12 and the like. Musical tone waveform data W01 to W04 respectively generated from the sound sources TG1 to TG4 are mixed together in a mixing circuit 50, from which the mixed musical tone waveform data is to be outputted. Such mixed musical tone waveform data is converted into the analog musical tone signal TS by a digital-to-analog (D/A) converting circuit 52. Then, this musical tone signal TS is supplied to the sound system 40 (shown in FIG. 1).

(3) Sound Source TG1 (FIG. 6)

FIG. 6 shows an example of the sound source TG1 which is designed to simulate sounds of the bowed stringed instrument.

Herein, a variable delay circuit 60, a filter 62, a multiplier 64, an adder 66, a variable delay circuit 68, a filter 70, a multiplier 72 and an adder 74 are connected together in a closed-loop, i.e., data circulating path. The total delay time of this data circulating path corresponds to the length of the string (i.e., vibrator), i.e., fundamental wave period of the sound to be generated. Herein, the transmission and distribution manner of the string vibration can be represented by the waveform data circulates through the data circulating path.

The delay times of the variable delay circuits 60, 68 are respectively controlled to match with the values of the delay data DLC11, DLC12. The waveform data circulating through the data circulating path is applied with the pitch corresponding to the total delay time of the delay circuits 60, 68. Strictly speaking, the pitch of the sound to be generated is determined based on the sum of the delay times of the closed-loop. Therefore, in order to obtain the pitch corresponding to the total delay time of the closed-loop, the total delay time of the delay circuits 60, 68 must be determined under consideration of other delay times of the filters and the like other than the delay circuits 60, 68.

The filters 62, 70 are provided to simulate the loss of the vibration transmission due to the material of the string or simulate the non-linear characteristic of the transmission velocity of the vibration frequency. When simulating the above-mentioned loss of the vibration transmission, the low-pass filter is employed as the filters 62, 70. When simulating the above-mentioned non-linear characteristic, the all-pass filter is employed. In this case, by using the non-linear characteristic of the frequency/delay characteristic of the all-pass filter, it is possible to actually generate the overtone of non-integral-degree.

The multipliers 64, 72 multiply the circulating waveform data by negative coefficients outputted from coefficient generators 76, 78 respectively, which will simulate the phase inversion representing the reflection of the vibration wave to be occurred at both of the fixed terminals of the string. In this case, when neglecting the vibration loss to be occurred at the fixed terminal of the string, this negative coefficient is set at −1". On the other hand, in order to incorporate the constant vibration loss, it is possible to set the corresponding and desirable value within the range between "0" and −1" as the negative coefficient, or it is possible to vary the negative coefficient according to needs in a lapse of time.

The adders 66, 74 are provided to introduce excitation waveform data from a non-linear conversion portion NL into the data circulating path.

The velocity data VEL is applied to the non-linear conversion portion NL via adders 82, 84. This non-linear conversion portion NL is provided to simulate the non-linear variation of the string to be bowed. This non-linear conversion portion NL provides a divider 86, a non-linear conversion memory 88 and a multiplier 90 to be connected in series, wherein output of the adder 84 is supplied to the divider 86. Further, the pressure data PRS is supplied to both of the divider 86 and multiplier 90, so that the multiplier 90 will output the excitation waveform data.

FIG. 7 shows an example of the non-linear variation of the bowed string, wherein the horizontal axis represents the relative moving velocity of the bow with respect to the string, while the vertical axis represents the displacement velocity imparted to the string from the bow. When the bowing velocity is in the vicinity of zero, the bow and string are mainly subject to the static friction, so that the string displacement velocity will linearly increase with the increase of the bowing velocity. However, if the external force is applied to some degree, the bow and string are mainly subject to the dynamic friction, in which the effect of the external force applied to the string displacement velocity is rapidly lowered. Thus, as shown in FIG. 7, the string displacement velocity is varied non-linearly. In addition, as shown in FIG. 7, the string displacement velocity is varied according to the hysteresis phenomenon at the transition point between the static friction and dynamic friction to be applied to the bow and string.

In order to simulate the non-linear characteristic as shown in FIG. 7, the non-linear conversion memory 88 stores numerical data according to the variation characteristic as shown by solid line A in FIG. 8, for example. In order to simulate the variation of the static frictional area corresponding to the bowing pressure, the divider 86 and multiplier 90 are respectively provided at the input and output of the non-linear conversion memory 88, wherein they perform the division and multiplication operations respectively with respect to the pressure data PRS. By dividing the input data of the memory 88 with the pressure data PRS, the characteristic A is varied to characteristic B as shown by dashed line in FIG. 8. By multiplying the output data of the memory 88 by the pressure data PRS, the characteristic B is further varied to characteristic C as shown by dotted line in FIG. 8. Incidentally, in order to achieve the change of the characteristic corresponding to the pressure data PRS, it is possible to employ the operation method other than that as shown in FIGS. 6 and 8. For example, the variation characteristic is memorized in the memory 88 with respect to each pressure value, so that the variation characteristic to be used is designated in response to the pressure data PRS.

For example, when inputting time-variable velocity data as shown in FIG. 9 into the non-linear conversion portion NL, this portion NL outputs excitation waveform data as shown in FIG. 10, and this excitation waveform data is applied to the data circulating path via the adders 66, 74.

In order to simulate the aforementioned hysteresis phenomenon, a feedback loop consisting of a low-pass filter (LPF) 92 and a multiplier 94 is provided for the non-linear conversion portion NL. Herein, output Q of the multiplier 90 is supplied to the LPF 92, of which output is then supplied to the multiplier 94 wherein it is multiplied by a coefficient generated from a coefficient generator 96. Then, multiplication result of the multiplier 94 is supplied to the adder 84 wherein it is added to output S of the adder 82. Thereafter, addition result S' of the adder 84 is supplied to the divider 86. The LPF 92 is provided for avoiding the oscillation and compensating the gain or phase. However, in response to the filter characteristic of the LPF 92, the output waveform of the non-linear conversion portion NL can be also varied. Thus, it is possible to vary the tone color by use of the LPF 92.

For example, in the case where certain conversion characteristic (i.e., characteristic between the input S' and output Q) as shown in FIG. 11 is imparted to the non-linear conversion portion NL and feedback rate $\beta$ is set equal to 0.1 (i.e., feedback rate is 10%), the whole conversion characteristic of the non-linear conversion portion NL and feedback loop (i.e., characteristic between the input S and output Q) is subject to the hysteresis characteristic as shown in FIG. 12. In this case, by varying the coefficient generated from the coefficient generator 96 so as to vary the feedback rate, it is possible to vary the hysteresis characteristic. On the other hand, by varying the feedback rate in response to the velocity data VEL and pressure data PRS, it is possible to generate the musical tones which are further similar to sounds of the bowed stringed instrument. Incidentally, the method for obtaining the hysteresis characteristic is not limited to the above-mentioned feedback method. For example, it is possible to modify the circuit configuration such that the conversion characteristic is memorized in the memory 88 with respect to each of the variation directions of its input value, and thereby the conversion characteristic to be used is designated in response to the variation direction of input value to be detected.

Meanwhile, an adder 98 adds outputs of the multipliers 64, 72 together, and the addition result thereof is supplied to the adder 82. By the provision of this adder 98, the circulating waveform data is passed through the non-linear conversion portion NL and then supplied to the data circulating path again, so that the complicated waveform variation can be obtained.

The musical tone waveform data WO1 consisting of the circulating waveform data is picked up from the output terminal of the multiplier 72. However, such pick-up point at which the musical tone waveform data is to be picked up is not limited to that as shown in FIG. 6, therefore, It is possible to pick up the musical tone waveform data from any point within the data circulating path. In addition, the number of the pick-up points is not limited to one, therefore, it is possible to pick up the musical tone waveform data from plural pick-up points. In this case, a plurality of the musical tone waveform data to be picked up from plural pick-up points can be mixed together into one musical tone waveform data to be outputted.

The sound source TG1 described above employs the delay loop structure containing the filter, so that it is subject to the characteristic of the so-called comb filter. Thus, when the data circulating path is applied with the excitation waveform data outputted from the non-linear conversion portion NL, the waveform data having the overtone spectrum structure circulates through the data circulating path, wherein such overtone spectrum structure is formed corresponding to the peak resonance frequencies of the comb filter.

The sound source TG1 is designed to generate the musical tone waveform data WO1 upon receipt of the velocity data VEL, pressure data PRS and delay data DLC11, DLC12 indicating the delay quantity. Therefore, if no key is depressed in the keyboard 36 or if any key is depressed but no keycode data is set in the register KCR1, the musical tone waveform data will not be generated even if the performer carries out the input operation on the input panel 34 with the electronic pen 34A. In addition, even if the keycode data is set in the register KCR1, the musical tone waveform data is not generated without carrying out the input operation with the electronic pen 34A.

When the input operation is started by use of the electronic pen 34A in the state where the keycode data is set in the register KCR1, it is possible to impart the varied expression manner to the musical tone at its rising portion in response to the manner of applying the operating force to the input panel 34 (e.g., manner in which the operating force is applied rapidly or gradually). By increasing or decreasing the operating velocity and/or operating pressure to be applied to the input panel 34, it is possible to impart the varied expression to the musical tone. Thereafter, when starting to attenuate the musical tone, it is possible to impart the varied expression to the musical tone at its falling portion in response to the manner of weakening the operating force (e.g., manner in which the operating force is weakened rapidly or gradually).

Similar expression can be imparted to the musical tone in the case where the keycode data is set in the register KCR1 in response to the key-depression after starting the input operation with the electronic pen 34A.

Meanwhile, when the register KCR1 is cleared in response to the key-release event to be occurred during generation of the musical tone, the delay circuits 60, 68 are turned off so that the musical tone will be rapidly attenuated. On the other hand, when the input operation by the electronic pen 34A is terminated without clearing the register KCR1 during generation of the musical tone, the circulating waveform data is subject to the loss of the data circulating path so that the musical tone will be gradually attenuated. In short, it is possible to select one of two attenuation manners, i.e., rapid-attenuation and gradual-attenuation manners.

The attenuation control accompanied with the key-release is not limited to the above-mentioned method in which the delay circuits 60, 68 are turned off. Therefore, it is possible to employ other methods, such as the method in which the variable attenuator is inserted in the data circulating path and then the attenuation rate thereof is increased when detecting the key-release event and the method in which the gains of the filters 62 and/or 70 are lowered when detecting the key-release event.

(4) Working Memory 16

Hereinafter, description will be given with respect to some of the registers provided within the working memory 16 which are required in the present embodiment.

(a) mode register MD)

In response to the operation of the mode switch, "1" or "0" is set in this mode register MD, wherein "1" represents the velocity mode and "0" represents the position mode.

(b) keycode register KCD

Every time the key-depression detecting circuit 24 detects the key-on or key-off event, this keycode register KCD stores the keycode data corresponding to the detected event.

(c) sound source on/off register KOR

This sound source on/off register KOR further contains four registers KOR1 to KOR4 respectively corresponding to four registers KCR1 to KCR4 shown in FIG. 5. Herein, "1" or "0" is stored in each register, wherein "1" represents the tone-generation state of the sound source and "0" represents the non-tone-generation state of the sound source.

(d) x-coordinate register X

The x-coordinate value detected by the coordinate/-pressure detecting circuit 22 is set in this x-coordinate register X.

(e) y-coordinate register Y

The y-coordinate value detected by the coordinate/-pressure detecting circuit 22 is set in this y-coordinate register Y.

(f) pressure register P

The pressure value detected by the coordinate/pressure detecting circuit 22 is set in this pressure register P.

(g) pen-state register PSW

This pen-state register PSW is used in the case where the electronic pen providing with the pen-point switch is used as the electronic pen 34A. Herein, "1" or "0" is set in this register, wherein "1" represents the on-state (i.e., contact state) of the pen-point switch and "0" represents the off-state (i.e., non-contact state) of the pen-point switch.

(h) previous x-coordinate register Xp

The x-coordinate value of the register X is set in this previous x-coordinate register Xp. In this case, the current x-coordinate to be generated at the current timer interruption is set in the former x-coordinate register X, while the previous x-coordinate which has been generated at the previous timer interruption is set in this previous x-coordinate register Xp.

(i) previous y-coordinate register Yp

The y-coordinate value of the register Y, i.e., previous y-coordinate which has been generated at the previous timer interruption is set in this previous y-coordinate register Yp.

(j) data flag OLD

This data flag OLD indicates whether or not the data is stored in the register Xp, Yp. More specifically, "1" or "0" is stored as this data flag OLD, wherein "1" indicates that the data is stored in the register Xp, Yp, while "0" indicates that no data is stored in the register Xp, Yp.

(k) distance register DIST

The unit-time moving distance data as shown by the horizontal axis of FIG. 3 is set in the distance register DIST.

[B] Operation

Next, description will be given with respect to the operation of the present embodiment by referring to the flowcharts as shown in FIGS. 13 to 16.

(1) Main Routine (FIG. 13)

FIG. 13 shows the processing of the main routine, which is activated in response to the power-on event and the like.

In first step 100, several kinds of the registers are initialized. For example, all of the aforementioned registers (see (a) to (k) described above) are cleared. Then, the processing proceeds to next step 102.

In step 102, it is judged whether or not any key-on event is occurred in the keyboard 36. If the judgement result is "YES" indicating that the key-on event is occurred in the keyboard 36, the key-on subroutine is executed in step 104, which will be described later in conjunction with FIG. 14.

On the other hand, if the judgement result of step 102 is "NO" indicating that no key-on event is occurred in the keyboard 36, the processing directly proceeds to step 106 wherein it is judged whether or not the key-off event is occurred in the keyboard 36. If the judgement result of step 106 is "YES", the processing proceeds to step 108 wherein the key-off subroutine is executed, which will be described later in conjunction with FIG. 15.

When the judgement result of step 106 is "NO", or when the process of step 108 is completed, the processing proceeds to step 110 wherein it is judged whether or not the on-event is occurred on the mode switch. If the judgement result of step 110 is "YES", the processing proceeds to step 112 wherein the mode register MD is set by the value which is obtained by subtracting the value of MD from "1" (i.e., "1"-MD). More specifically, "1" is set in the mode register MD if the value of MD is at "0", while "0" is set in the mode register MD if the value of MD is at "1". As a result, every time the mode switch is turned on, one of the position mode and velocity mode is alternatively designated.

When the judgement result of step 110 is "NO", or when the process of step 112 is completed, the processing proceeds to step 114 wherein other processes (e.g., process of setting the tone volume) will be executed. Thereafter, the processing returns to step 102, so that the above-mentioned processes will be repeatedly executed.

(2) Key-On Subroutine (FIG. 14)

FIG. 14 shows the key-on subroutine, wherein the keycode concerning the key-on event is set in the keycode register KCD in step 120. Then, the processing proceeds to next step 122.

In step 122, it is judged whether or not "0" is set in any one of the registers KOR1 to KOR4 within the sound source on/off register KOR. If the judgement result of step 122 is "NO" indicating that all of the sound sources are used, the processing returns to the main routine shown in FIG. 13 without executing the keycode interrupt process. Incidentally, even if all of the sound sources are used, it is possible to modify the present system such that the data is rewritten with respect to the register corresponding to the first key-on event.

If the judgement result of step 122 is "YES", the processing proceeds to step 124 wherein the keycode of the keycode register KCD is set to one of the registers KCR1 to KCR4 (see FIG. 5) corresponding to one of the registers KOR1 to KOR4 which value is judged at "0". Then, the processing proceeds to step 126.

In step 126, "1" is set in the register (KOR) corresponding to the register (KCR) to which the keycode is set. Then, the processing returns to the main routine shown in FIG. 13.

According to the key-on subroutine shown in FIG. 14, if the register KOR1 is at "0", the keycode is set in the register KCR1 and "1" is set in the register KOR1, which enables the tone-generation of the sound source TG1.

(3) Key-Off Subroutine (FIG. 15)

FIG. 15 shows the key-off subroutine, wherein the keycode concerning the key-off event is set in the keycode register KCD. Then, the processing proceeds to step 132.

In step 132, It is judged whether or not the same keycode of the keycode register KCD is stored in any one of the registers KCR. Even if the judgement result of this step 132 is "NO", the keycode process is not required because the musical tone corresponding to the key-off event is not generating at the present stage, so that the processing returns to the main routine shown in FIG. 13.

If the judgement result of step 132 is "YES", the processing proceeds to step 134 wherein the CPU 12 clears the register KOR corresponding to the register KCR which stores the same keycode of the register KCD. In short, "0" is set in this register KOR. In next step 136, the CPU 12 clears the register KCR which stores the same keycode of the register KCD, so that the processing returns to the main routine shown in FIG. 13.

According to the key-off subroutine shown in FIG. 15, in the case where the register KCR1 stores the same keycode of the keycode register KCD, both of the registers KOR1, KCR1 are cleared. In response to the clearing operation of the register KCR1, the delay circuits 60, 68 within the sound source TG1 shown in FIG. 6 are turned off, so that the present system starts to attenuate the musical tone which is currently generating. Incidentally, it is possible to modify the present system such that the muting processes are all performed in response to the releasing operation of the pen (i.e., operation in which the value of the aforementioned pressure register P or pen-state register PSW is changed to "0") without performing the clearing operation in the key-off event.

(4) Timer Interrupt Routine (FIG. 16)

FIG. 16 shows the timer interrupt routine, which is activated by every clock timing of the timer clock signal TMC (e.g., 3 ms).

In first step 140, the x-coordinate value, y-coordinate value and pressure value from the coordinate/pressure detecting circuit 22 are set in the registers X, Y, P. In the case where the pen having the pen-point switch is used as the electronic pen 34A, state signal of the pen-point switch (i.e., "1" or "0") is set in the pen-state register PSW.

Next, in step 142, it is judged whether or not all of the registers KOR are set at "0". If the judgement result of this step 142 is "YES" indicating that all of the sound sources are not used for generating the musical tones, the processing directly returns to the main routine shown in FIG. 13.

On the other hand, if the judgement result of step 142 is "NO", the processing proceeds to step 144 wherein it is judged whether or not the value of the pressure register P is at "0" (indicating that the electronic pen 34A is in the non-contact state). In the case where the pen having the pen-point switch is used as the electronic pen 34A, It is judged whether or not the pen-state register PSW is at "0" instead of judging whether or not the pressure register P is at "0". If the judgement result of this step 144 is "YES", the processing directly returns to the main routine shown in FIG. 13 because the following processes described below are not required.

If the judgement result of step 144 is "NO", the processing proceeds to step 146 wherein the pressure data corresponding to the contents of the pressure register P is read from the pen-pressure/bowing-pressure conversion memory 20 and then it is set in the register PR (see FIG. 5). Then, the processing proceeds to step 148.

In step 148, it is judged whether or not the contents of the mode register MD is at "1" (indicating the velocity mode). If the judgement result of this step 148 is "NO", the processing proceeds to step 150.

In step 150, the velocity data corresponding to the contents of the x-coordinate register X is read from the memory 18A and then it is set in the register VR (see FIG. 5). Due to the process of step 150, it is possible to designate the velocity in response to the x-coordinate value (i.e., operating position in x-direction) as shown in FIG. 2. For example, in the input panel 34 (see FIG. 2), when designating the x-coordinate value in the right-side area from Xm/2, it is possible to obtain the velocity having the positive value corresponding to the designated x-coordinate value. This positive velocity corresponds to the bowing-velocity or input shown in FIG. 7 or 8 in the down-bow direction. On the other hand, when designating the x-coordinate value in the left-side area from Xm/2, it is possible to obtain the velocity having the negative value corresponding to the designated x-coordinate. This negative velocity corresponds to the bowing-velocity or input shown in FIG. 7 or 8 in the up-bow direction.

When completing the process of step 150, the processing returns to the main routine shown in FIG. 13.

If the judgement result of step 148 is "YES", the processing proceeds to step 152 wherein It is judged whether or not the data flag OLD is at "0" (indicating that no data is stored in the registers Xp, Yp). For example, in the case where the processing proceeds to step 152 at first after the power-on event, the judgement result of step 152 turns to "YES" so that the processing proceeds to step 154.

In step 154, "1" is set to the data flag OLD. In next step 156, the values of the registers X, Y are respectively set in the registers Xp, Yp. Then, the processing returns to the main routine shown in FIG. 13.

Thereafter, when the processing enters into the timer interrupt routine shown in FIG. 16 again, the judgement result of step 152 turns to "NO" so that the processing proceeds to step 158.

In step 158, the following formulae (1), (2) are to be operated by use of the values of the registers X, Xp, Y, Yp.

$$\sqrt{(Xp - X)^2 + (Yp - Y)^2} \quad (1)$$

$$Xp - X \quad (2)$$

Then, the operation result of the formula (1) is added with the sign corresponding to the operation result of the formula (2), which result is set in the distance register DIST.

In step 160, the velocity data corresponding to the contents of the distance register DIST is read from the memory 18B, and then it is set to the register VR (see FIG. 5). Then, after the values of the registers X, Y are respectively set to the registers Xp, Yp in step 156, the processing returns to the main routine of FIG. 13.

By the processes of steps 152 to 160, it is possible to designate the velocity corresponding to the unit-time moving distance (i.e., the operating velocity on the surface of the input panel 34) as shown in FIG. 3. For example, when the electronic pen 34A is moved in the right direction on the surface of the input panel 34, the subtraction result of (Xp-X) turns to the negative value so that the positive velocity value can be obtained as shown in FIG. 3. This positive velocity corresponds to the bowing-velocity or input shown in FIG. 7 or 8 in the bow-down direction. On the other hand, when the electronic pen 34A is moved in the left direction, such subtraction result turns to the positive value so that the negative velocity value can be obtained in FIG. 3. This negative velocity corresponds to the bowing-velocity or input shown in FIG. 7 or 8 in the up-bow direction.

In the above-mentioned process of step 158, it is possible to apply the sign of (Yp-Y) instead of the sign of (Xp-X). In this case, the direction from y=0 to y=Ym corresponds to the up-bow direction, while the reverse direction thereof corresponds to the down-bow direction. In addition, it is possible to modify the process of step 150 such that the velocity data corresponding to the value of the register Y is read from the memory 18A and then set to the register VR. Thus, it is possible to designate the velocity corresponding to the operating position in y-direction.

[C] Modified Examples

The present embodiment according to the present invention is not limited to the above-mentioned configuration and operation. Therefore, it is possible to modify the present embodiment as follows.

(1) The present embodiment is not limited to the polyphonic electronic musical instrument, therefore, it can be applied to the monophonic electronic musical instrument.

(2) The operating device is not limited to the digitizer, therefore, it is possible to employ other operating devices such as the mouse-type device which can move in the two-dimensional area. In addition, the input device is not limited to the input panel using the pen, therefore, it is possible to employ the touch-input type input panel.

(3) Instead of using the sound source circuit which simulates the sounds of the bowed stringed instrument, it is possible to use the other known sound source circuits which simulate the sounds of the wind instrument and the like.

(4) It is possible to convert the velocity information into acceleration information and use it for the musical tone control.

II. SECOND EMBODIMENT

Next, description will be given with respect to the second embodiment of the present invention by referring to FIGS. 17 to 20.

[A] Configuration

FIG. 17 shows the whole configuration of the electronic musical instrument employing the musical tone control apparatus according to the second embodiment of the present invention, wherein parts identical to those shown in FIG. 1 are designated by the same numerals, hence, description thereof will be omitted.

Figure 18:
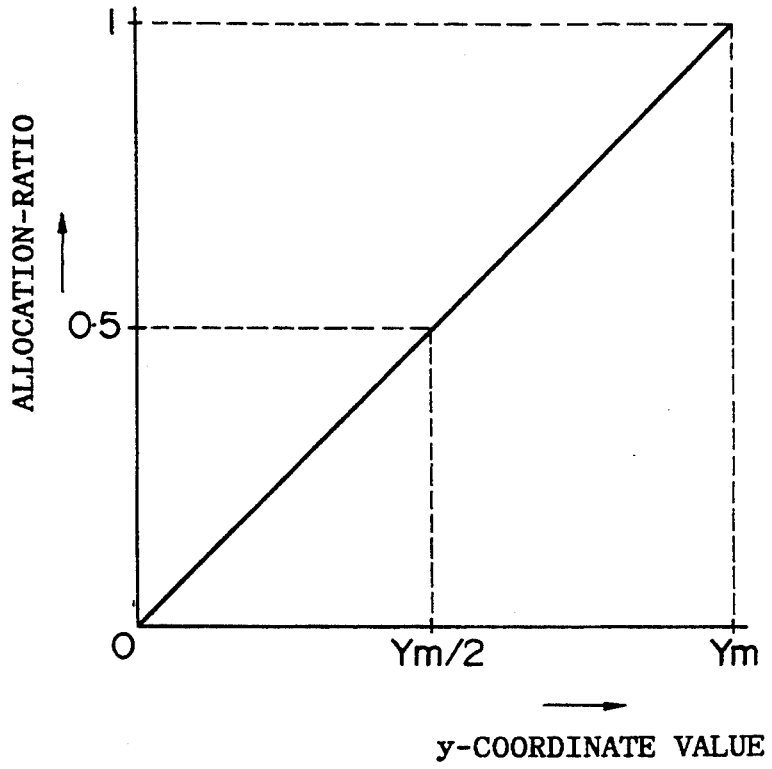
FIG. 18 is a graph showing conversion characteristic of a coordinate/allocation-ratio conversion memory employed in the second embodiment.

This second embodiment is characterized by providing a coordinate/allocation-ratio conversion memory 21. This memory 21 is used for determining the allocation ratio of the total delay quantity corresponding to the musical tone to be generated. More specifically, such total delay quantity is allocated to the first and second variable delay elements (i.e., delay circuits 60, 68 shown in FIG. 6 which shows the detailed configuration of the sound source shown in FIG. 19) by the allocation-ratio. Herein, FIG. 18 shows an example of the conversion characteristic of this memory 21. In FIG. 18, the horizontal axis represents the y-coordinate value, e.g., 0-Ym/2-Ym within the effective read area ER of the input panel 34, while the vertical axis represents the allocation ratio to the first variable delay element wherein the total delay quantity is set corresponding to "1". According to this conversion characteristic, when the y-coordinate value detected by the foregoing coordinate/pressure detecting circuit 22 is at Ym/2, the allocation ratio 0.5 is set to the first variable delay element, for example. In this case, the allocation ratio to the second variable delay element is also set at 0.5 (=1−0.5).

Figure 19:
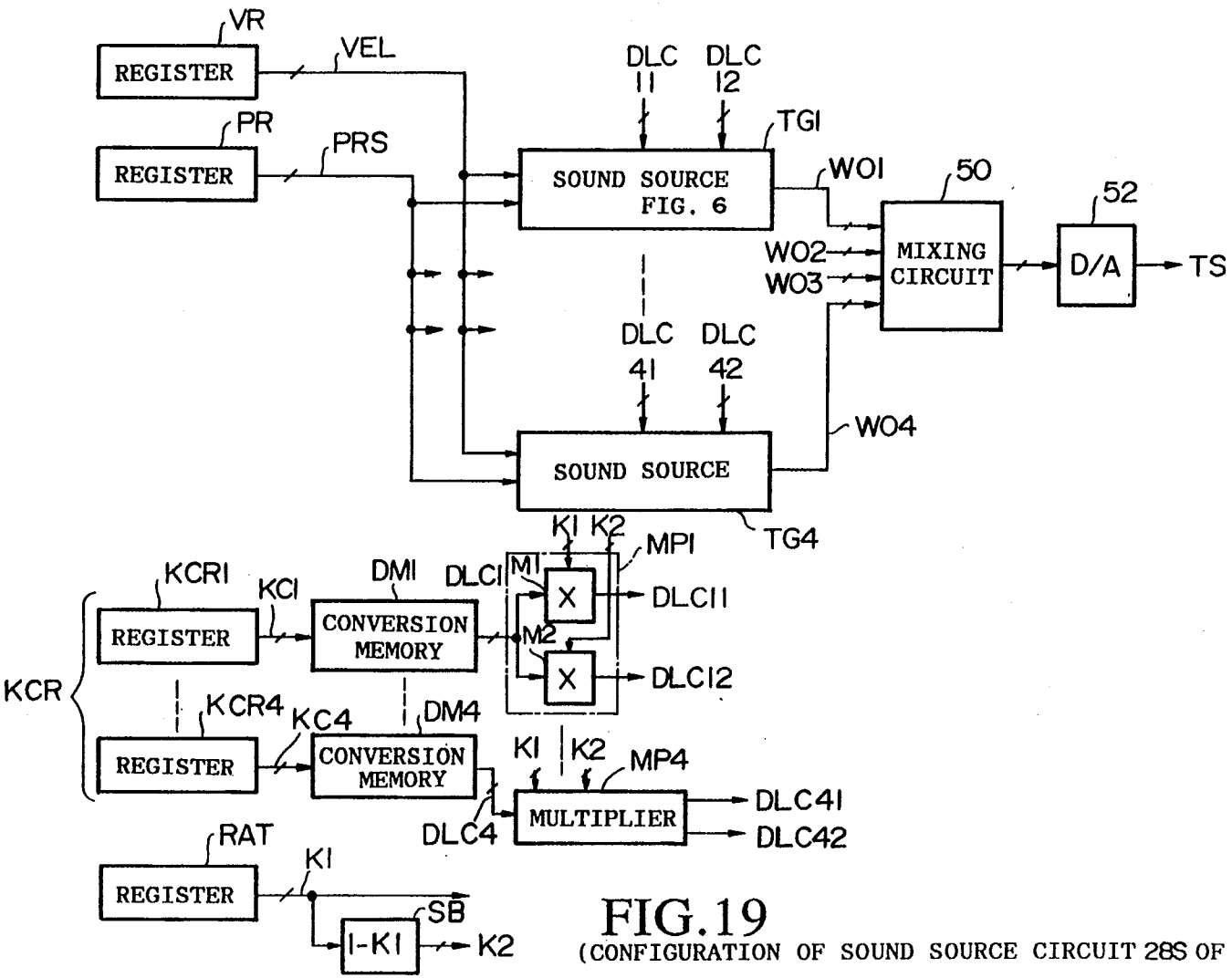
FIG. 19 is a block diagram showing configuration of a sound source circuit shown in FIG. 17.

Next, description will be given with respect to the sound source circuit 28S according to the second embodiment shown in FIG. 17 by referring to FIG. 19. In FIG. 19, parts identical to those shown in FIG. 5 will be designated by the same numerals, hence, description thereof will be omitted. This sound source circuit 28S is characterized by providing multiplier circuits MP1 to MP4, a register RAT and a subtractor SB.

As similar to the foregoing sound source circuit 28 shown in FIG. 5, this sound source circuit 28S contains four sound sources TG1 to TG4 respectively corresponding to four strings of the violin.

The conversion memories DM1 to DM4 respectively output the delay data DLC1 to DLC4 each corresponding to the total delay quantity, which are respectively supplied to the multiplier circuits MP1 to MP4.

Meanwhile, the register RAT stores the allocation-ratio data read from the memory 21. Then, this register RAT outputs first allocation-ratio data K1 to the multiplier circuits MP1 to MP4 and subtractor SB. The subtractor SB subtracts the value of allocation-ratio data K1 from "1", which subtraction result is supplied to the multiplier circuits MP1 to MP4 as second allocation-ratio data K2.

Each of the multiplier circuits MP1 to MP4 has the same construction and operation, therefore, description will be only given with respect to the multiplier circuit MP1. This multiplier circuit MP1 contains two multipliers M1, M2 each receiving the delay data DLC1 from the conversion memory DM1. The multiplier M1 multiplies the delay data DLC1 by the first allocation-ratio data K1 from the register RAT, which multiplication result is supplied to the sound source TG1 as the delay data DLC11. On the other hand, the multiplier M2 multiplies the delay data DLC1 by the second allocation-ratio data K2 from the subtractor SB, which multiplication result is supplied to the sound source TG1 as the delay data DLC12.

For example, when the first allocation-ratio data K1 is at 0.8, the second allocation-ratio data K2 is at 0.2. In this case, the delay data DLC11 is set at the value which is obtained by multiplying value N (e.g., number of delay stages) of the delay data DLC1 by 0.8, while the delay data DLC12 is set at the value which is obtained by multiplying N by 0.2. Incidentally, when the value of register KCR1 is at "0" (indicating that no keycode data is stored), certain values of the delay data DLC11, DLC12 are supplied to the sound source TG1 so that the first and second delay elements therein (e.g., delay circuits 60, 68 shown in FIG. 6) are turned off.

Similarly, the delay data DLC21, 22 to DLC41, 42 are respectively supplied to other sound sources TG2 to TG4.

[B] Operation

Next, description will be given with respect to the operation of the second embodiment, wherein its main routine, key-on and key-off subroutines are identical to those of the first embodiment as shown in FIGS. 13 to 15, hence, description thereof will be omitted.

Herein, only the timer interrupt routine of the second embodiment is partially different from that of the first embodiment. More specifically, as comparing to FIG. 16, FIG. 20 is characterized by processes of step 145, 158S, 156S which corresponds to the provision of the coordinate/allocation-ratio conversion memory 21. Hence, description will be only and mainly given with respect to these processes.

In step 144, when the judgement result is "NO" indicating that P does not equal to "0" (i.e., the electronic pen 34A is in contact with the input panel 34), the processing proceeds to step 145 wherein the allocation-ratio data corresponding to the value of the register Y is read from the memory 21 and then set in the register RAT (see FIG. 19). Then, the processing proceeds to step 146.

Thereafter, when the judgement result of step 152 turns to "NO" indicating that the data is set in the register Xp, the processing proceeds to step 158S. In step 158S, subtraction result of (Xp-X) is set to the distance register DIST. Then, the processing proceeds to step 160 wherein the velocity data corresponding to the value of DIST is read from the memory 18B and then set it to the register VR (see FIG. 19). Thereafter, the value of the register X is set to the register Xp in next step 156S, and the processing returns to the main routine shown in FIG. 13.

Thus, due to the allocation-ratio to be employed in the second embodiment, it is possible to impart the further varied expression to the musical tone to be generated as comparing to the first embodiment.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A musical tone control apparatus comprising:

(a) operating means which is capable of being freely moved on a two-dimensional plane;

(b) detecting means for detecting operation information corresponding to an operating position or an operating displacement of said operating means on said two-dimensional plane, and for producing a detected position output signal;

(c) velocity information generating means for generating a velocity information signal based on said detected position output signal; and (d) musical tone generating means for generating a musical tone having a musical characteristic corresponding to said velocity information signal.

2. A musical tone control apparatus according to claim 1 further providing pitch designating means for designating a pitch of said musical tone to be generated, whereby said musical tone generating means generates said musical tone having the pitch designated by said pitch designating means.

3. A musical tone control apparatus according to claim 1 or 2 wherein said velocity information generating means generates said velocity information signal corresponding to said operating position of said operating means.

4. A musical tone control apparatus according to claim 1 or 2 wherein said velocity information generating means generates said velocity information signal corresponding to an operating velocity of said operating means to be moved.

5. A musical tone control apparatus according to claim 1 or 2 further providing mode selecting means for arbitrarily selecting one of first and second modes, wherein said velocity information generating means generates said velocity information signal corresponding to said operating position of said operating means when said first mode is selected, while said velocity information generating means generates said velocity information signal corresponding to an operating velocity of said operating means to be moved when said second mode is selected.

6. A musical tone control apparatus according to any one of claims 1 or 2 wherein said detecting means detects an operating pressure of said operating means to thereby generate corresponding pressure information, so that said musical tone generated from said musical tone generating means is controlled in response to said pressure information.

7. A musical tone control apparatus according to claim 1 wherein said information generating means comprises means for generating a velocity information signal based on changes in said detected position output signal.

8. A musical tone control apparatus according to claim 1 wherein said operating means is operated by a performer and is separate from the performer.

9. A musical tone control apparatus comprising:

(a) operating means which is capable of being freely moved in a two-dimensional area;

(b) detecting means for detecting operation information corresponding to an operating position or an operating displacement of said operating means upon movement in a first direction, said detecting means also detecting position information corresponding to an operating position of said operating means moved in a second direction crossing said first direction;

(c) velocity information generating means for generating a velocity information signal based on said detected operation information;

(d) musical tone signal generating means for generating a musical tone signal having a musical characteristic corresponding to said velocity information signal; and (e) control means for controlling said musical characteristic of said musical tone signal based on said detected position information.

10. A musical tone control apparatus according to any one of claims 1 or 9 wherein said operating means is configured by a digitizer on which surface an electronic pen is moved by a performer so that a coordinate-position, a moving velocity and/or a pressure applied to said electronic pen are to be detected by said detecting means.

11. A musical tone control apparatus according to claim 9 wherein said velocity information generating means generates said velocity information signal corresponding to the operating position of said operating means.

12. A musical tone control apparatus according to claim 9 wherein said velocity information generating means generates said velocity information signal corresponding to an operating velocity of said operating means to be moved.

13. A musical tone control apparatus according to any one of claims 9 to 12 wherein said detecting means detects pressure information corresponding to an operating pressure of said operating means, so that said control means controls the musical characteristic of said musical tone signal based on said pressure information.

14. A musical tone control apparatus comprising:

(a) data circulating path which is configured by connecting first and second variable delay elements each of which includes a variable delay time quantity, first and second phase inverters together into a closed-loop;

(b) designating means for designating a total delay quantity of determined by summing said delay qualities of said first and second variable delay elements in response to a pitch of a musical tone to be generated;

(c) operating means which can be operated in a two-dimensional area;

(d) detecting means responsive to an operation of said operating means for detecting operation information corresponding to an operating position or an operating displacement of said operating means to be moved in a first direction, said detecting means also detecting position information corresponding to an operating position of said operating means to be moved in a second direction crossing said first direction;

(e) velocity information generating means for generating velocity information based on said operation information;

(f) converting means for converting said position information into allocation-ratio information representative of an allocation rate by which said total delay quantity is allocated to said first and second variable delay elements respectively;

(g) control means for controlling respective delay quantities of said first and second variable delay elements so as to allocate said total delay quantity to said first and second variable delay elements respectively in accordance with said allocation-ratio information;

(h) input means for converting said velocity information into excitation waveform information which is inputted into and then circulated through said data circulating path; and (i) pick-up means for picking up circulating waveform information having said pitch as musical tone waveform information at a predetermined position within said data circulating path.

15. A musical tone control apparatus according to claim 14 wherein said detecting means detects pressure information corresponding to an operating pressure of said operating means, so that said input means converts said velocity information into said excitation waveform information in accordance with a conversion characteristic corresponding to said pressure information.

16. A musical tone control apparatus according to claim 14 wherein said operating means is configured by a digitizer on which surface an electronic pen is moved by a performer so that a coordinate-position, a moving velocity and/or a pressure applied to said electronic pen are to be detected by said detecting means.

17. A musical tone control method comprising the steps of:

putting an operating device into contact with a surface;

moving said operating device while at least one portion of said operating device remains in contact with said surface at a point of contact;

detecting a movement of said point of contact between said operating device and said surface converting said detected movement of said operating device into an electronic operation information signal;

generating an electronic velocity information signal based on said operation information; and electronically generating a musical tone having a musical characteristic corresponding to said electronic velocity information signal.

18. A musical tone control apparatus according to claim 14 wherein said operating device is separate from the performer.

* * * * *